US008141491B1

(12) United States Patent
Travis

(10) Patent No.: US 8,141,491 B1
(45) Date of Patent: Mar. 27, 2012

(54) EXPANDING TUBE SEPARATION DEVICE

(75) Inventor: Robert D. Travis, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 262 days.

(21) Appl. No.: 12/542,783

(22) Filed: Aug. 18, 2009

(51) Int. Cl.
*F42B 15/38* (2006.01)

(52) U.S. Cl. ..... 102/378; 102/377

(58) Field of Classification Search ..... 102/377, 102/378; 89/1.14, 1.57
See application file for complete search history.

(56) References Cited

U.S. PATENT DOCUMENTS

| | | | | |
|---|---|---|---|---|
| 4,348,956 | A * | 9/1982 | Schmidlin | 102/377 |
| 5,129,306 | A | 7/1992 | Fauvel | |
| 5,390,606 | A * | 2/1995 | Harris | 102/378 |
| 5,743,492 | A * | 4/1998 | Chan et al. | 244/118.2 |
| 5,898,123 | A * | 4/1999 | Fritz et al. | 102/378 |
| 6,021,715 | A | 2/2000 | Fritz et al. | |
| 6,076,467 | A * | 6/2000 | Cespedosa et al. | 102/378 |
| 6,125,762 | A | 10/2000 | Fritz et al. | |
| 6,289,818 | B1 * | 9/2001 | Mueller et al. | 102/377 |
| 7,922,125 | B2 * | 4/2011 | Lancho Doncel | 244/173.1 |

FOREIGN PATENT DOCUMENTS

| | | | |
|---|---|---|---|
| DE | 3833698 | A1 | 4/1990 |
| EP | 0596400 | A2 | 5/1994 |
| FR | 2850454 | A1 | 7/2004 |
| FR | 2888925 | A1 | 1/2007 |
| WO | 9901714 | A1 | 1/1999 |

OTHER PUBLICATIONS

Invitation to Pay Additional Fees from corresponding International Application No. PCT/US10/31678.

* cited by examiner

*Primary Examiner* — Bret Hayes
(74) *Attorney, Agent, or Firm* — Renner, Otto, Boisselle & Sklar, LLP

(57) ABSTRACT

A separation device for separating parts along a seam includes a frangible structure and a pressure tube assembly within the frangible structure. The pressure tube assembly includes a pressure tube which contains an explosive detonation assembly/cord that can be initiated to expand the pressure tube, and break the frangible structure with a shock force. The pressure tube assembly also includes a explosive manifold that is recessed in the frangible structure, not protruding from an outer surface of the frangible structure. The explosive manifold receives the ends of the pressure tube, and includes a detonator for detonating the explosive detonation assembly/cord. The explosive manifold has circular-cross-section fittings for accepting a circular ends of the pressure tube. By not having any part of the pressure tube assembly protrude from the frangible structure, improved performance may be achieved. Having circular fittings also improves the seal between the pressure tube and the explosive manifold.

20 Claims, 8 Drawing Sheets

EXPANDING TUBE SEPARATION DEVICE

GOVERNMENT RIGHTS

This invention was made with United States Government support under Contract Number HQ0276-08-C-0001 with the Department of the Navy. The United States Government has certain rights in this invention.

BACKGROUND OF THE INVENTION

1. Technical Field of the Invention

The invention is in the field of devices for physically separating structures or portions of structures.

2. Description of the Related Art

Separation devices for physically separating parts, such as stages of a rocket or missile, have involved frangible components that are fractured by a pressure tube containing an explosive detonation assembly/cord that is initiated. There is room for improvement/modification in such devices.

SUMMARY OF THE INVENTION

According to an aspect of the invention, a pressure tube assembly of a separation device is recessed within a frangible structure of the separation device, with no substantial part of the pressure tube assembly protruding beyond an outer surface of the frangible structure.

According to another aspect of the invention, no substantial part of a pressure tube assembly protrudes beyond a separation surface or plane of the frangible structure.

According to another aspect of the invention, a pressure tube of a separation device has an oval cross-section center section and circular cross-section ends.

According to yet another aspect of the invention, a separation device has a pressure tube that contains an explosive detonation assembly/cord, and has circular cross-section ends. The ends engage round bosses or fittings of an explosive manifold. Clamps may be used to secure the ends to the bosses, such securing possibly including deforming material of the round ends, for example with the deformed material entering retention grooves of the bosses.

According to still another aspect of the invention, a separation device includes: a frangible structure having an outer surface to be located along a seam between parts to be separated; and a pressure tube assembly fit into the frangible structure. The pressure tube assembly includes a pressure tube containing an explosive detonation assembly/cord that, when initiated, the explosive assembly/cord fractures the frangible structure along the outer surface; a detonator for initiating the explosive detonation assembly/cord. The entire explosive assembly consists of an explosive manifold which the detonator screws into as the donor port, and then the explosive detonation assembly/cord is secured on the remaining two additional acceptor ports as is the end of the pressure tube, so as to allow initiation of the explosive detonation assembly/cord by the detonator. The pressure tube, the detonator, and the explosive manifold are all substantially fully within the outer surface of the frangible structure.

According to another aspect of the invention, a separation device includes: a frangible structure having an outer surface to be located along a seam between parts to be separated; and a pressure tube assembly fit into the frangible structure. The pressure tube assembly includes: a pressure tube containing an explosive detonation assembly/cord that, when initiated, fractures the frangible structure along the outer surface; a detonator for initiating the explosive detonation assembly/cord; and the explosive manifold which contains all the explosive components, so as to allow initiation of the explosive detonation assembly/cord by the detonator. The pressure tube includes a casing that has substantially circular cross-section ends that engage round bosses of the explosive manifold.

According to yet another aspect of the invention, a method of making a pressure tube of a separation device includes the steps of: providing a casing that includes substantially circular cross-section ends, and an oval cross-section center portion; passing spacing cords through one of the circular cross-section ends into the oval cross-section center portion of the casing; and inserting a charge holder into the casing, such that the charge holder is between the spacing cords in the oval cross-section center portion of the casing, and such that a portion of the explosive detonation assembly/cord which is enclosed by the charge holder, extends out of at least one of the ends at the conclusion of the inserting.

To the accomplishment of the foregoing and related ends, the following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various features of the invention.

DETAILED DESCRIPTION

A separation device for separating parts along a seam includes a frangible structure and a pressure tube assembly within the frangible structure. The pressure tube assembly includes a pressure tube which contains an explosive detonation assembly/cord that can be initiated to expand the pressure tube, and break the frangible structure with a shock force or energy. The pressure tube assembly also includes an explosive manifold that is recessed in the frangible structure, neither protruding from an outer surface of the frangible structure, nor protruding beyond a frangible structure separation surface or plane. The explosive manifold accepts the ends of the pressure tube, and includes a detonator which is screwed into the donor port for initiation of the explosive detonation assembly/cord. The explosive manifold has circular-cross-section bosses or fittings for accepting both circular ends of the pressure tube. Other parts of the pressure tube have an oval cross section, for better performance and to facilitate their fitting into the frangible structure. By not having any part of the pressure tube assembly protrude (radially) from the frangible structure, improved aerodynamics may be achieved when the separation device is used for stage separation in a rocket or missile, for instance. In addition, because no part of the pressure tube assembly protrudes (axially) beyond the separation surface or plane, the risk of tip off may be reduced or avoided. Having circular fittings also improves the seal between the pressure tube and the explosive manifold.

Figure 1:
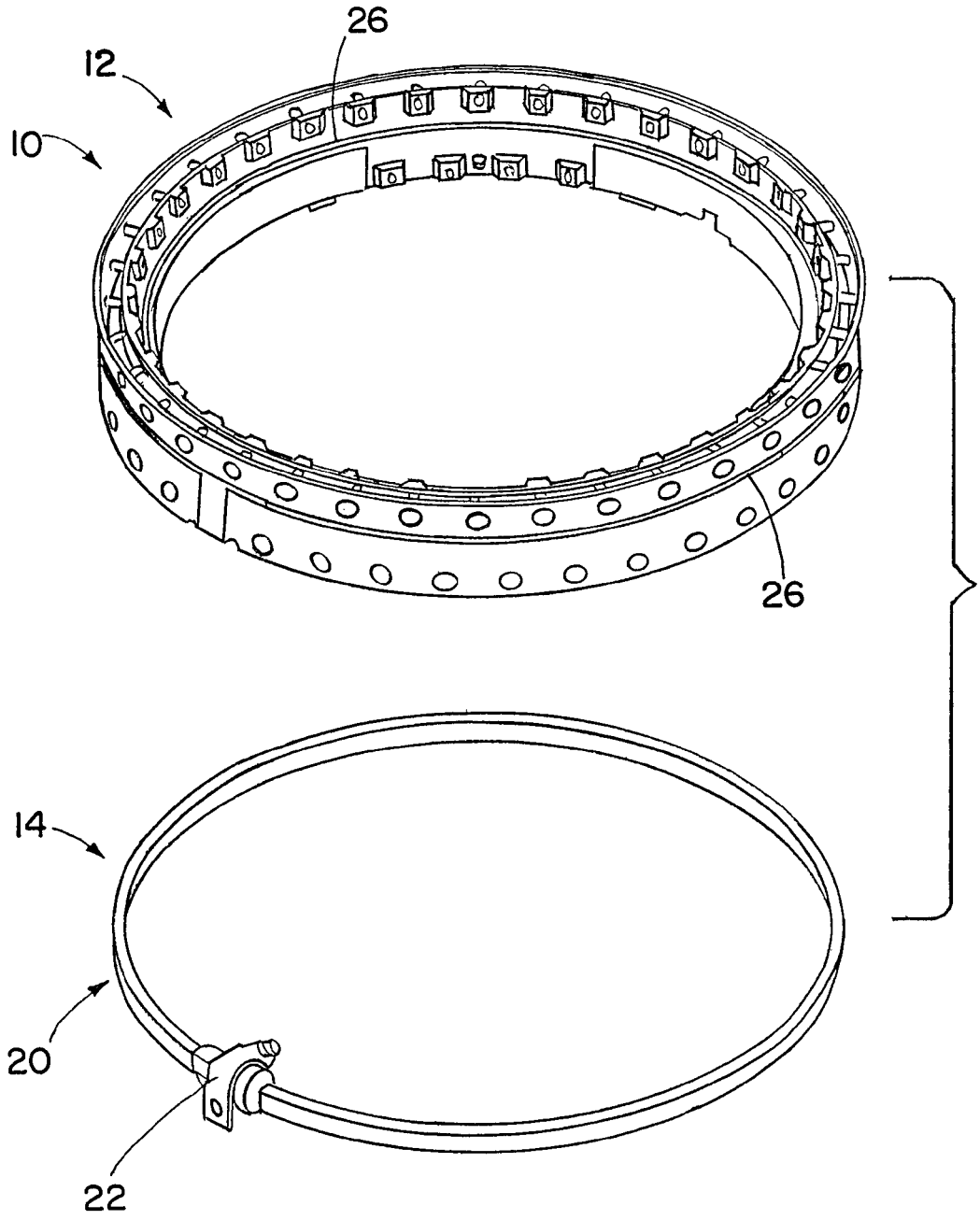
FIG. 1 is an exploded view of a separation device in accordance with an embodiment of the invention.

FIG. 1 shows a separation device 10 for separating parts along a seam. The separation device 10 includes a frangible structure 12, which in the illustrated embodiment is a frangible ring structure, and a pressure tube assembly 14. The frangible structure 12 is attached to structure parts on opposite sides of the seam. The pressure tube assembly 14 includes a pressure tube 20 and an explosive manifold 22. As described in greater detail below, the pressure tube 20 includes an explosive detonation assembly/cord within a metal casing. Detonation of the explosive detonation assembly/cord expands the metal casing outward. This produces a shock that fractures the frangible structure 12 along a pretreated fracture line 26. The fracture line 26 may be a location on the frangible structure 12 where material has been thinned, such as by having a groove in one or both sides of the frangible structure 12. The frangible structure 12 may be made of extruded aluminum or another suitable material. As described in further detail below, the detonation process is initiated by an initiator and other devices which are located in the explosive manifold 22.

Figure 2:
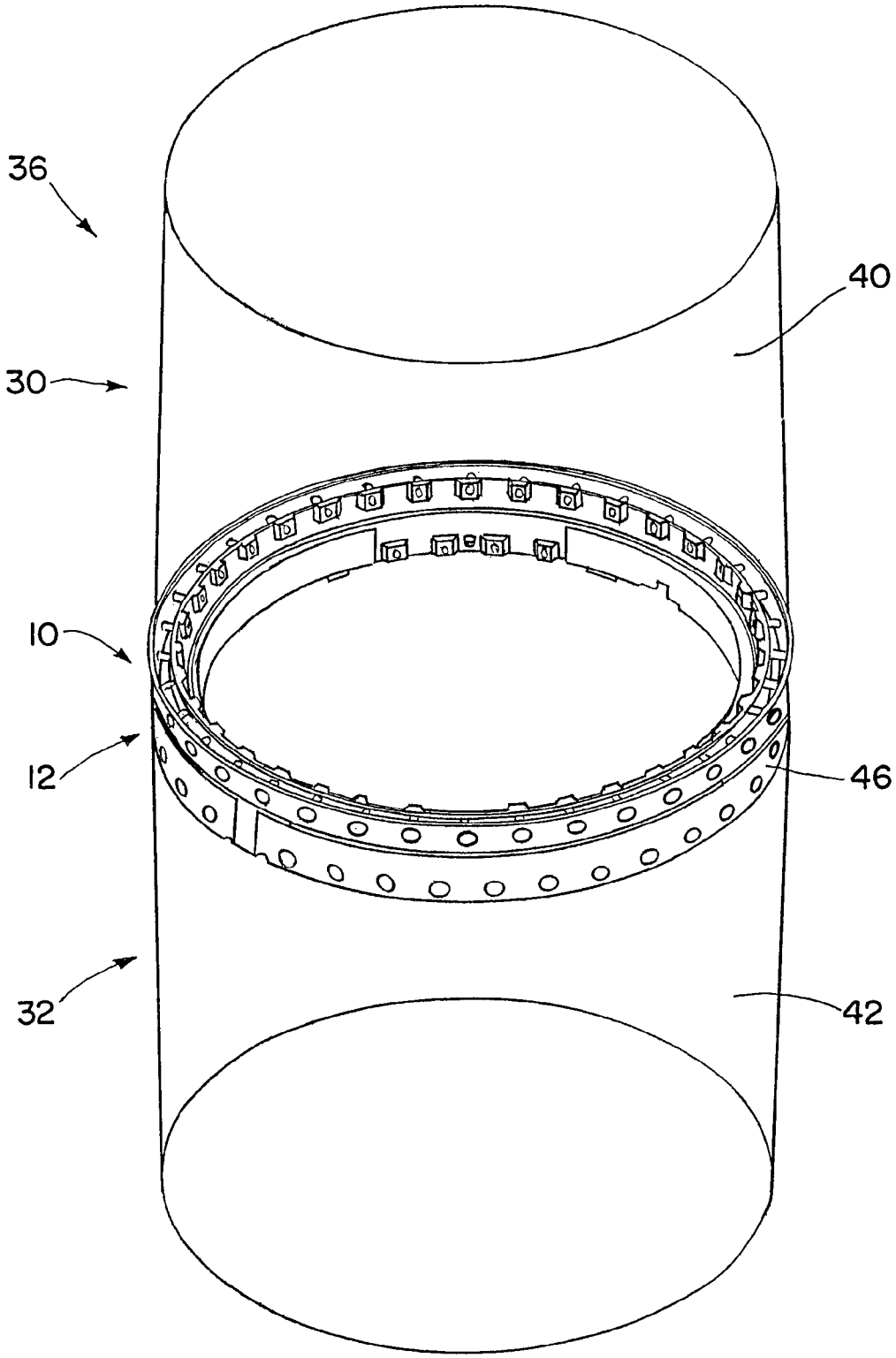
FIG. 2 is a view showing the separation device of FIG. 1 as part of a rocket or missile.

Referring to FIG. 2, the separation device 10 is shown linking a pair of stages 30 and 32 of a rocket or missile 36. The casings 40 and 42 of the stages 30 and 32 are mechanically connected to opposite sides of the frangible structure 12, with the frangible structure 12 providing the main physical connection between the stages 30 and 32 prior to stage separation, and perhaps substantially the only physical connection between the stages 30 and 32.

An outer surface 46 of the frangible structure 12 provides part of an outer surface of the rocket or missile 36. No part of the pressure tube assembly 14 (FIG. 1) protrudes beyond the frangible structure outer surface 46. In particular, the explosive manifold 14 is recessed within the separation device 10, not protruding beyond the outer surface 46. By having substantially all pressure tube assembly 14 located within the frangible structure 12, the missile or rocket 36 has better aerodynamic properties than rockets or missiles that utilize separation devices that have an explosive manifold or other parts protruding beyond an outer surface of a frangible structure. This advantage is contrasted with prior configurations in which substantial parts of the explosive manifold protrude from the outer surface of the frangible structure.

Figure 4B:
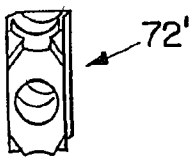
FIG. 4B shows an alternate embodiment charge holder usable as part of the separation device of FIG. 1.
Figure 4A:
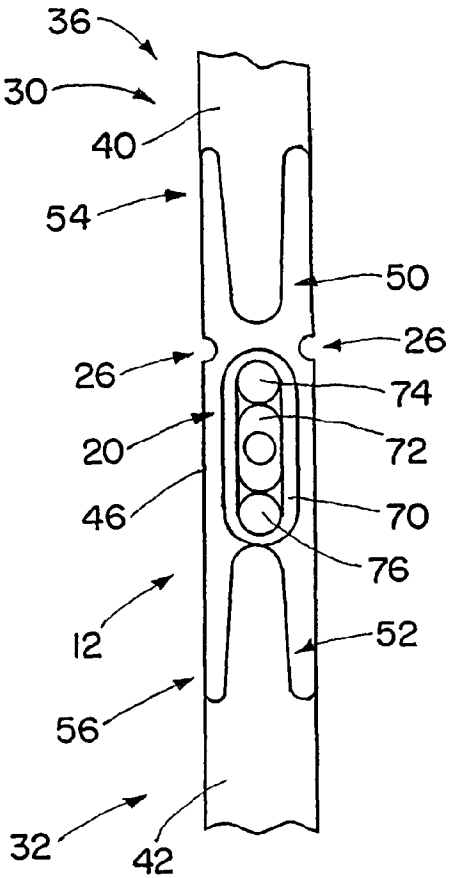
FIG. 4A is a sectional view showing details of another part of the rocket or missile of FIG. 2, including another part of the separation device of FIG. 1.
Figure 3:
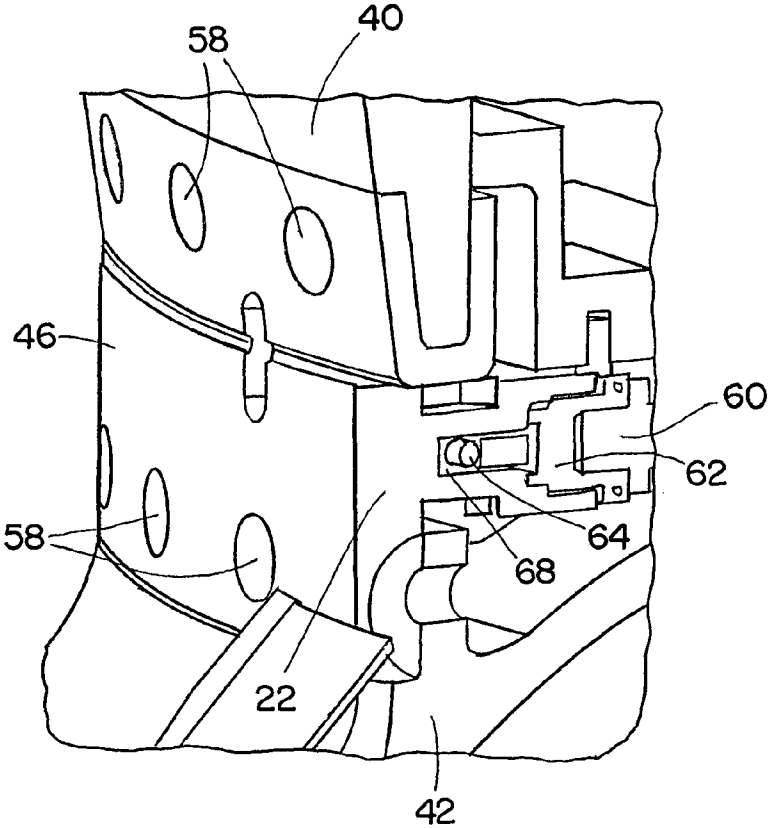
FIG. 3 is a cutaway detailed view of part of the rocket or missile of FIG. 2, including part of the separation device of FIG. 1.

The casings 40 and 42 may be physically joined to opposite ends of the frangible structure 12 by any of a variety of methods. Referring now in addition to FIGS. 3 and 4A, the casings 40 and 42 may fit into respective slots or notches 50 and 52 at forked ends 54 and 56 at the top and bottom of the frangible structure 12. Fasteners 58, for example rivets or suitable threaded fasteners such as screws or bolts, may be used to secure the casings 40 and 42 to the structure ends 50 and 52. Although the separation device 10 is described herein as being separate from the casings 40 and 42, it will be appreciated that alternatively the frangible structure 12 could be combined with and be part of either of the casings 40 and 42.

In FIGS. 3 and 4A it can be seen that the pressure tube 20 and the explosive manifold 22 are substantially completely located below the fracture line 26. Since the fracture line 26 is where the stages 30 and 32 separate, it will be appreciated that most of the mass of the separation device 10, for example including the mass of substantially all of the pressure tube assembly 14, remains with the stage 32 after the separation of the stage 32 from the stage 30. It will be appreciated that this configuration may provide significant advantages. For example, one advantage of the configuration is reducing the likelihood and/or severity of tip-off in separation. In separating stages of a missile or rocket, the presence of an explosive manifold portion above the separation line can lead to tipping when separation occurs, imparting the remaining part of the rocket or missile with a moment having a component perpendicular to the longitudinal (central) axis of the rocket or missile. Locating substantially all of the explosive manifold 22 below the separation line, and within the outer surface 46 of the frangible structure 12, reduces or eliminates the potential for tip off problems.

Another example is that the stage 32 may be a first stage that is discarded after burning, and the stage 30 may be a second stage that remains with the rocket or missile 36 after separation of the first stage 32. By locating substantially all of the pressure tube assembly 14 so that it remains with the first stage 32, there is less mass travelling with the rocket or missile 36 after the separation of the first stage 32. Reducing the after-separation mass reduces the amount of thrust required and the amount of fuel needed to continue to drive the rocket or missile 36.

The pressure tube assembly 14 includes an initiator 60 and a detonator booster assembly 62, which are coupled to the explosive manifold 22. The initiator 60 and the detonator 62 are used to initiate an explosive detonation assembly/cord 64 within the pressure tube 20. The explosive detonation assembly/cord 64 protrudes into a chamber 68 in the explosive manifold 22. Example materials for the explosive detonation assembly/cord 64 include a core of 24 grains per linear foot hexanitrostilbene (HNS) in an aluminum jacket, or cyclotetramehylene tetranitramine (HMX), which is a typical composite material for explosive transfer lines. The initiator 60 converts electrical input into an explosive detonation/shockwave, and the detonator booster 62 amplifies this detonation so as to produce a detonation/shockwave which will then detonate the explosive detonation assembly/cord 64.

The explosive detonation assembly/cord 64 is centrally located in the pressure tube 20. Except at the ends of the pressure tube 20 (discussed below), the pressure tube 20 has an oval cross-section shape. On the outside of the pressure tube 20 is a stainless steel or other metal casing (cup) 70 that encloses the contents inside. The explosive detonation assembly/cord 64 is held in place inside the steel casing 70 by a charge holder 72 and a pair of charge holder spacing cords 74 and 76. The charge holder 72 surrounds the explosive detonation assembly/cord 64 and contacts the side surfaces of the casing 70. This keeps the explosive detonation assembly/cord 64 horizontally centered within the casing 70. The charge holder 72 may be made of an elastomeric material, such as a silicone polymer, that may burn or otherwise vaporize as a result of detonation of the explosive detonation assembly/cord 64. The explosive detonation assembly/cord 64 may be located substantially at the center of the charge holder 72.

The spacing cords 74 and 76 are placed above and below the charge holder 72, and may be made of the same material as the charge holder 72. The spacing cords 74 and 76 are used to keep the charge holder 72 (and the explosive detonation assembly/cord 64) vertically spaced within the casing 70. The spacing cords 74 and 76 may have a round cross-section shape, and may fit into the bottom and top rounded ends of the inside surface of the casing 70.

The charge holder 72 may have an oval shape, with a central circular recess for accepting the explosive detonation assembly/cord 64. Alternatively the charge holder may have a shape with top and bottom recesses, for more securely engaging the spacing cords 74 and 76, such as is shown in the charge holder 72' of FIG. 4B. This configuration results in a greater percentage of volume inside of the casing 70 being filled by the charge holder material.

The use of the spacing cords 74 and 76 as pieces separate from the charge holder 72 may facilitate assembly of the pressure tube 20. Specifically the pressure tube 20 may have a circular-shaped ends, as described further below, ends that would not permit undeformed passage of a charge holder that fully filled the inner area enclosed by the casing 70. By dividing the spacing material into multiple parts assembly can be facilitated, while still accomplishing the goal of maintaining the explosive detonation assembly/cord 64 securely centered vertically and horizontally within the casing 70 and while still providing ample combustible material volume.

In operation of the separation device 10, an electrical current is provided to the initiator 60 to produce an explosive detonation/shockwave. This detonation is transferred and amplified by the detonator booster 62. The boosted explosive shockwave then initiates the ends of the explosive detonation assembly/cord 64 contained within the explosive manifold assembly 68. This velocity of this explosive shockwave causes detonation of the entire explosive detonation assembly/cord 64, producing heat and pressurized gasses. The resulting vaporization of all or part of the charge holder 72 and the explosive detonation/cords 74 may produce further pressurized gasses. The pressurized gasses within the casing 70 provide an outward shockwave to the side walls of the casing 70, tending to change the shape of the casing 70 from an oval to a circle. This explosive shockwave is transmitted outward from the casing 70 to the frangible structure 12. The shock on the frangible structure 12 causes the structure 12 to fracture along its pretreated fracture line 26, which is located along the seam of the parts to be separated.

Figure 5:
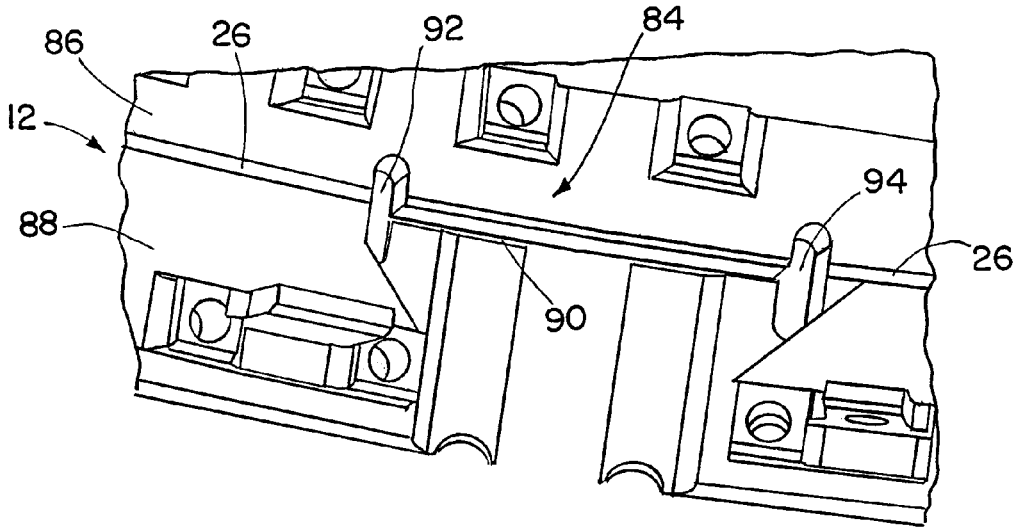
FIG. 5 is a fragmentary view of part of a frangible structure of the separation device of FIG. 1.

With reference to FIG. 5, the frangible structure 12 includes a preseparated region, an H-shaped slot 84 at the same level as the fracture line 26, where the top frangible structure portion 86 is not connected to the bottom frangible structure portion 88. The slot 84 is located in the vicinity of the explosive manifold 22 (FIG. 3) when the pressure tube assembly 14 (FIG. 1) is installed in the frangible structure 12. The slot 84 is located where the pressure tube 20 (FIG. 1) transitions from an oval to a circular cross section, and where the detonator core 64 enters the explosive manifold 22. The slot 84 has a broad horizontal central portion 90, with vertical portions 92 and 94 on either ends. The vertical slot portions 92 and 94 have rounded corners that avoid stress concentrations.

Figure 6:
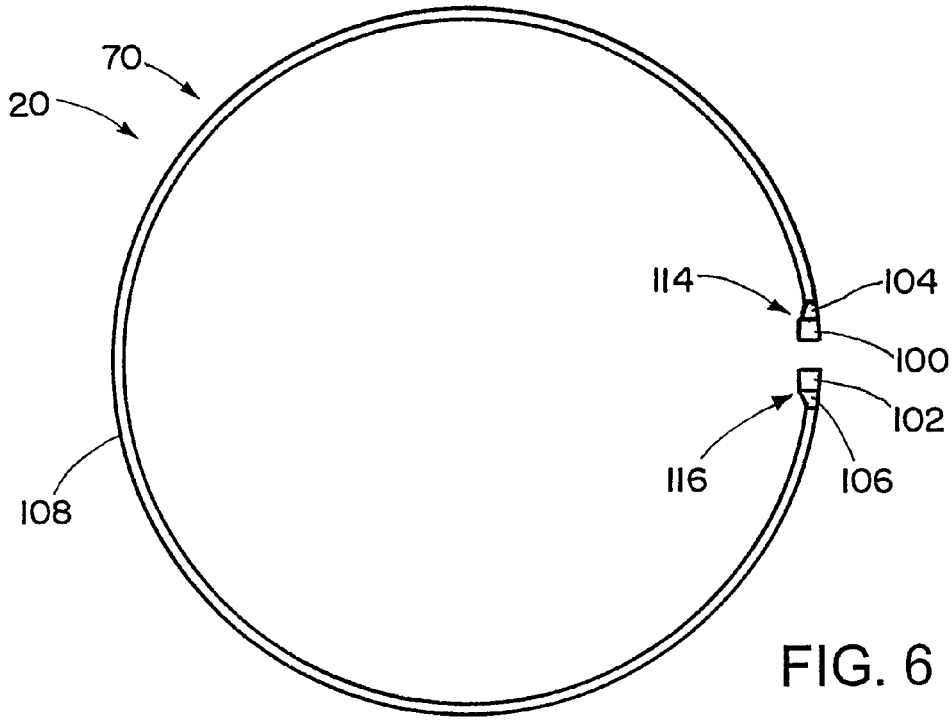
FIG. 6 is a plan view of a pressure tube of the separation device of FIG. 1.
Figure 7:
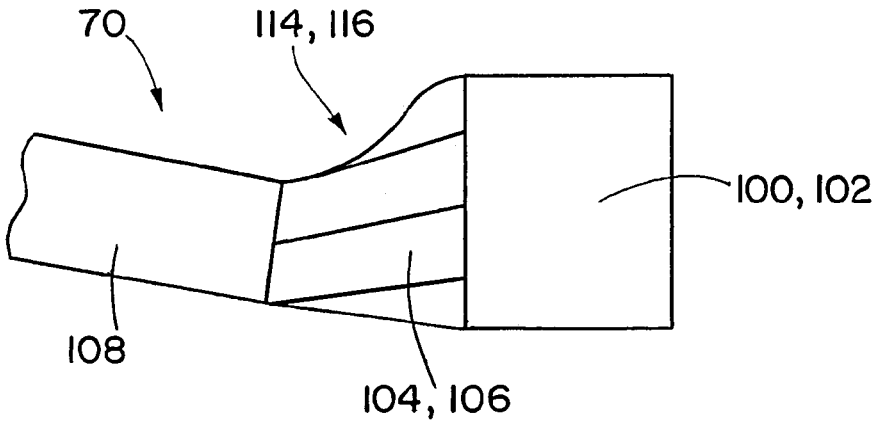
FIG. 7 is a detailed view showing an end of a casing of the pressure tube of FIG. 1.
Figure 8:
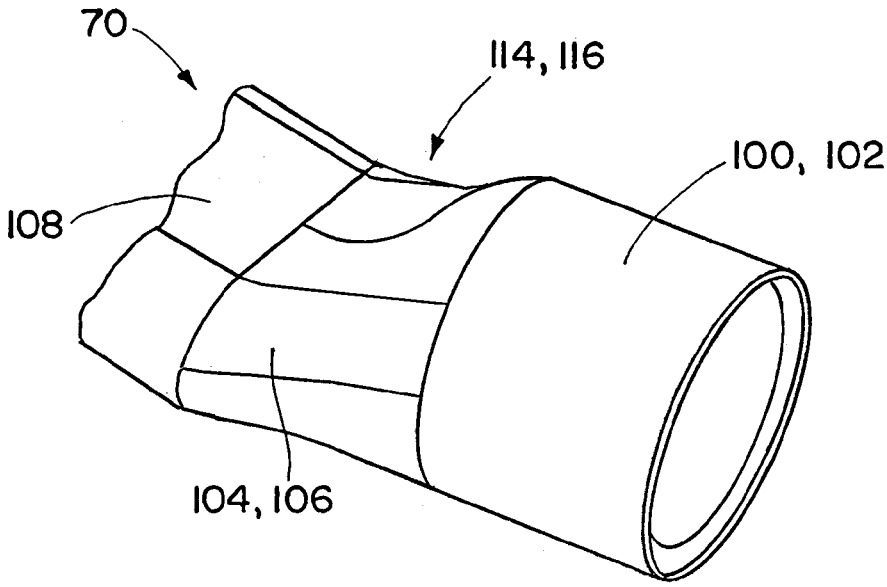
FIG. 8 is another detailed view showing an end of the casing of the pressure tube of FIG. 1.

Turning now to FIGS. 6 through 8, the casing 70 of the pressure tube 20 has rounded ends 100 and 102 having circular cross sections. Respective transition portions or regions 104 and 106 are located between the round ends 100 and 102, and the oval central portion 108 that forms most of the length of the pressure tube 20. The transition regions 104 and 106 have natural transition outer portions and tight inner portions with "corners" (tightly curved areas) 114 and 116. The corners 114 and 116 facilitate assembly of the pressure tube 20 into the frangible structure 12 (FIG. 1).

The casing 70 may be formed by taking circular cross-section tubing, and then flattening the middle part of the tubing to form the oval central portion 108. Alternatively, the ends of initially oval cross-section tubing may be worked to produce the circular cross-section ends 100 and 102, and the transition regions 104 and 106. For example, a female die may be used to set the overall shape of the casing 70, with a series of cammed (internal) mandrels used reshape (reround) the ends 100 and 102. This working may be done at elevated temperature, or alternatively may be cold working. Suitable forming processes may be used to shape the casing 70.

In assembling the pressure tube 20 first the spacing cords 74 and 76 (FIG. 4A) are inserted into the casing 70, along the top and bottom of the casing 70. Sealant may be used to hold the spacing cords 74 and 76 in their desired locations within the oval central portion 108 of the casing 70. It will be appreciated that the spacing cords 74 and 76 can be easily fed through circular ends 100 and 102 and the transition regions 104 and 106, either individually or at the same time. Once installed, the spacing cords 74 and 76 are only located in the central portion 108, and do not extend into the transition regions 104 and 106.

After the spacing cords 74 and 76 have been installed, the charge holder 72 and explosive detonation assembly/cord 64 may be inserted into the casing 70. The charge holder 72 is fed through one of the circular ends 100 and 102. The charge holder 72 is passed into the central casing portion 108 until part of the charge holder 72 extends into the other of the ends 100 and 102, and until the explosive detonation assembly/cord 64 extends further, out of the other of the ends 100 and 102.

Figure 9:
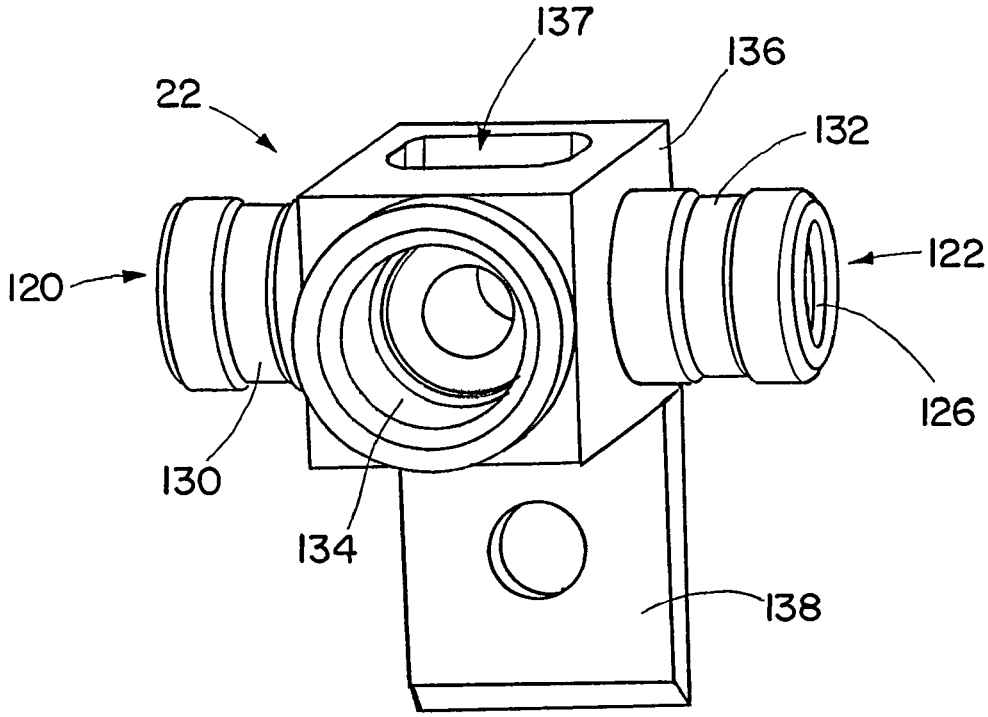
FIG. 9 is an oblique view of an explosive manifold of the separation device of FIG. 1.
Figure 10:
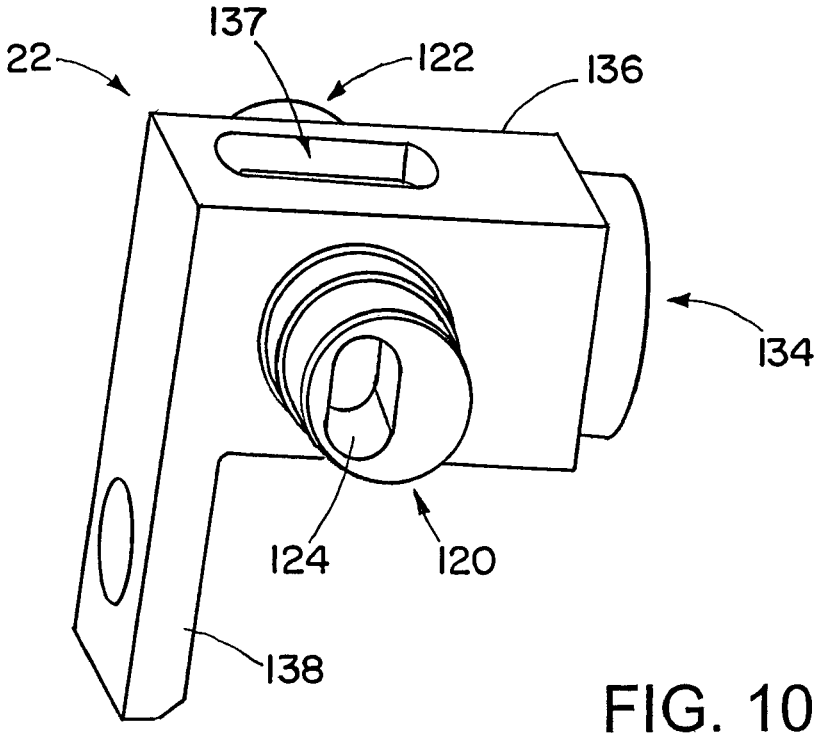
FIG. 10 is another oblique view of the explosive manifold of FIG. 9.

FIGS. 9 and 10 show various aspects of the explosive manifold 22. The explosive manifold 22 has a pair of fittings 120 and 122, round bosses for receiving the ends 100 and 102 of the pressure tube 20 (FIG. 2). The fittings or bosses 120 and 122 have circular cross sections, with respective recesses 124 and 126 for accepting portions of the charge holder 72. At least one of the recesses 124 and 126 has a hole that allows at least one part of the explosive detonation assembly/cord 64 to pass into the detonation chamber 68 of the explosive manifold 22. The fittings 120 and 122 also have recessed perimeter surfaces (retention grooves) 130 and 132 in their cylindrical outer surfaces. The recessed surfaces or sections (grooves) 130 and 132 are used to aid in clamping the ends 100 and 102 to the fittings 120 and 122. The recessed perimeter sections or grooves 130 and 132 may have substantially rectangular cross section shapes. The explosive manifold 22 also has a donor port 134 for accepting the initiator 60 (FIG. 3) and the detonator 62 (FIG. 3). The fittings 120 and 122, and the port 134, may be joined to or parts of an explosive manifold body 136. The explosive manifold body 136 may have a hogout or recess 137 in order to reduce weight. A flange or tab 138 may protrude downward from the explosive manifold body 136, and may be used to secure the explosive manifold 22 to device structure, such as the casing 42 (FIG. 2).

Figure 11:
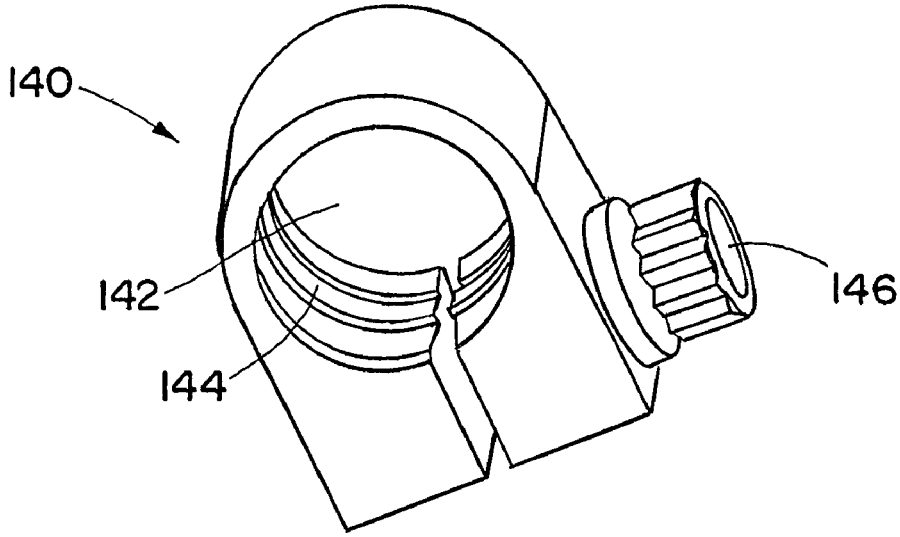
FIG. 11 is an oblique view of a first embodiment clamp usable as part of the separation device of FIG. 1.
Figure 12:
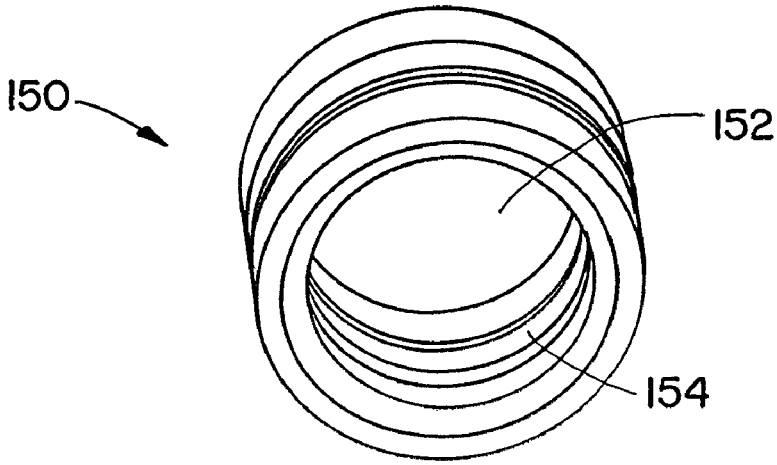
FIG. 12 is an oblique view of a second embodiment clamp usable as part of the separation device of FIG. 1.

FIGS. 11 and 12 show two possible clamps for clamping the pressure tube ends 100 and 102 (FIG. 6) to the explosive manifold fittings 120 and 122 (FIG. 9). A round screw clamp 140 (FIG. 11) has a round opening 142 large enough to fit over the tube ends 100 and 102. The clamp 140 has a radially inward protrusion 144 that may correspond in shape and location to the recessed sections or grooves 130 and 132 (FIG. 9) of the fittings 120 and 122. The clamp 140 has a tightening screw or bolt 146 which is tightened to constrict the opening 142. In use the loosened clamp 140 is slid over a tube end 100 or 102. The tube end 100 or 102 is then placed over one of the explosive manifold fittings 120 and 122. The screw 146 is then tightened to clamp the material of the casing end 100 or 102 against the fitting 120 and 122. This clamping may also involve providing a seal, for example to prevent egress of pressurized gasses from the connection between tube end and fitting. The clamping may involve deforming some of the material of the tube end 100 or 102. In particular the inward protrusion 144 bears against the casing material during tightening, and may deform material of the casing end to push some of the casing material into at least part of the recessed perimeter section 130 or 132. The deforming of material increases strength of the connection and/or effectiveness of the sealing.

FIG. 12 shows an alternative clamp configuration, a swaged clamp 150 having a ring shape with a round opening 152. The (installed or swaged) clamp 150 also has a radially inward protrusion 154 protruding into the opening 152. The clamp 150 is placed over a tube end 100 or 102 (FIG. 6) that is placed over a fitting 120 or 122 (FIG. 9). The ring clamp 150 is then swaged (squeezed with an appropriate tool) to deform the material of the clamp 150 and secure the tube end 100 or 102 to the fitting 120 or 122. The inward protrusion 154 may deform material of the tube end and drive that tube end material into the recessed section 130 or 132 (FIG. 9). This may provide the benefits described above with regard to the securing and/or sealing.

Figure 13:
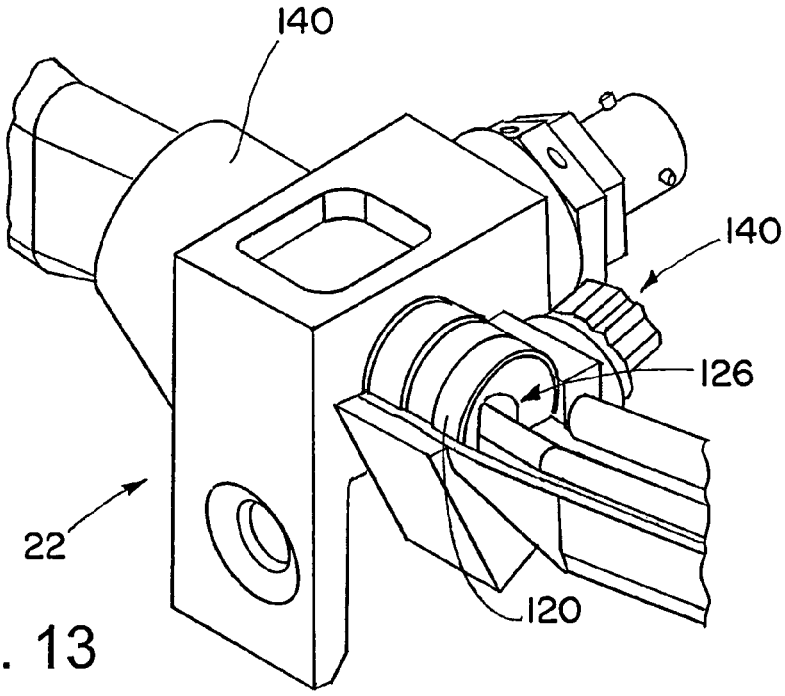
FIG. 13 is a cutaway view showing connection of the pressure tube of FIG. 6 to the explosive manifold of FIG. 9, using the clamp of FIG. 11.
Figure 14:
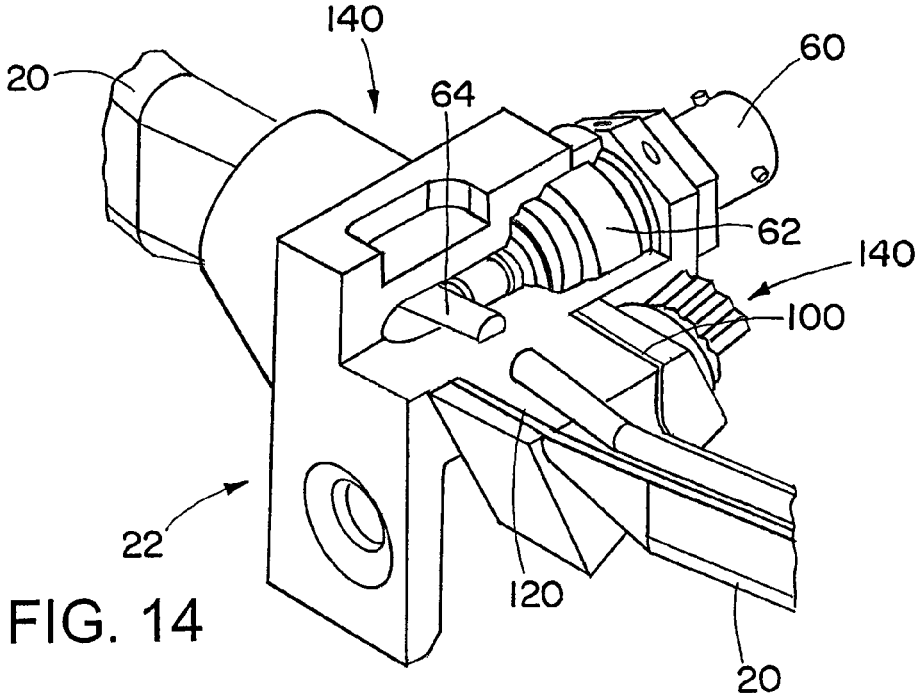
FIG. 14 is another cutaway view showing the connection of FIG. 13.

FIGS. 13 and 14 show the pressure tube ends 100 and 102 (FIG. 6) secured to the bosses 120 and 122 (FIG. 9) using a pair of the clamps 140.

The parts of the separation device 10 may be made of any of a variety of suitable materials, for example steel (or stainless steel, titanium, or copper) for the casing 70 and the explosive manifold 22, and extruded aluminum (or cast aluminum, titanium, or cast magnesium) for the frangible structure 12. Various methods may be used in forming the parts of the separation device, including extruding, cutting, rolling, casting, powder metallurgy, and/or, machining.

It will be appreciated that many configurations are possible for separation devices as described above. The separation device may be configured for placement on any of a wide variety of sizes and shapes of seams, to physically connect and then selectively physically separate parts, pieces, or objects on opposite sides of the seams. It will be appreciated that more than one separation device may be placed along a seam, for example to separate different regions at different times, to provide redundancy of detonation, and/or to facilitate assembly and/or manufacture. For example, a pair of semicircular pressure tubes may be used to separate rocket or missile stages, with a pair of explosive manifolds with detonators connected to ends of both of the pressure tubes, in order to provide redundant detonation.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A separation device comprising:

a frangible structure having an outer surface to be located along a seam between parts to be separated; and a pressure tube assembly fit into the frangible structure;

wherein the pressure tube assembly includes:

a pressure tube containing an explosive detonation assembly/cord that, when initiated, fractures the frangible structure along the outer surface;

a detonator for detonating the explosive detonation assembly/cord; and an explosive manifold coupling together the detonator and an end of the pressure tube, so as to allow detonation of the explosive detonation assembly/cord by the detonator; and wherein the pressure tube, the detonator, and the explosive manifold are all substantially fully within the outer surface of the frangible structure.

2. The separation device of claim 1, wherein the frangible structure is a ring-shape structure.

3. The separation device of claim 1, wherein the explosive manifold is substantially all to one side of a pretreated fracture line of the frangible structure where the frangible structure fractures when the explosive detonation assembly/cord is initiated.

4. The separation device of claim 3, wherein substantially all of the pressure tube is to the one side of the pretreated fracture line of the frangible structure.

5. The separation device of claim 3, wherein most of the mass of the frangible structure is to the one side of the pretreated fracture line of the frangible structure.

6. The separation device of claim 1, wherein the frangible structure has a slot that is a gap in a pretreated fracture line of the frangible structure where the frangible structure fractures when the explosive detonation assembly/cord is initiated; and wherein the slot is at a location where the frangible structure covers the explosive manifold.

7. The separation device of claim 6, wherein the slot is an H-shape slot.

8. The separation device of claim 1, wherein the pressure tube includes a casing that has substantially circular cross-section ends that engage round bosses of the explosive manifold; and wherein the casing has an oval cross-section center portion between the ends.

9. A separation device comprising:

a frangible structure having an outer surface to be located along a seam between parts to be separated; and a pressure tube assembly fit into the frangible structure;

wherein the pressure tube assembly includes:

a pressure tube containing an explosive detonation assembly/cord that, when initiated, fractures the frangible structure along the outer surface;

a detonator for detonating the explosive detonation assembly/cord and an explosive manifold coupling together the detonator and an end of the pressure tube, so as to allow detonation of the explosive detonation assembly/cord by the detonator; and wherein the pressure tube includes a casing that has substantially circular cross-section ends that engage round bosses of the explosive manifold.

10. The separation device of claim 9, wherein the casing has an oval cross-section center portion between the ends.

11. The separation device of claim 10, wherein the casing includes transition regions between the oval cross-section center portion and the substantially circular cross-section ends.

12. The separation device of claim 11, wherein the casing is curved; and wherein the transition regions each have sharper corners on an inner face than on an outer face.

13. The separation device of claim 9, wherein the pressure tube assembly further includes clamps that secure the tube ends to the bosses.

14. The separation device of claim 13, wherein the clamps have inward protrusions that correspond in location to grooves in the bosses, and that urge material of the casing ends into the grooves.

15. The separation device of claim 14, wherein the clamps include threaded fasteners that are tightened to clamp the casing ends to the bosses.

16. The separation device of claim 14, wherein the clamps are swaged to clamp the casing ends to the bosses.

17. The separation device of claim 14, wherein the pressure tube, the detonator, and the explosive manifold are all substantially fully within the outer surface of the frangible structure.

18. A method of making a pressure tube of a separation device, the method comprising:

providing a casing that includes substantially circular cross-section ends, and an oval cross-section center portion;

passing spacing cords through one of the circular cross-section ends into the oval cross-section center portion of the casing; and inserting a charge holder into the casing, such that the charge holder is between the spacing cords in the oval cross-section center portion of the casing, and such that a portion of an explosive detonation assembly/cord enclosed by the charge holder extends out of at least one of the ends at the conclusion of the inserting.

19. The method of claim 18, wherein the passing includes securing the spacing cords to top and bottom portions of inside surfaces of the casing, within the oval cross-section center portion of the casing.

20. The method of claim 18, wherein the providing includes:

flattening initially circular tubing to produce the oval shape of the central portion of the casing; and working ends of the tubing to produce the circular cross-section ends of the casing.

* * * * *